US006748997B2

(12) United States Patent
Fricano et al.

(10) Patent No.: US 6,748,997 B2
(45) Date of Patent: Jun. 15, 2004

(54) REINFORCED SUPPORT ELEMENT FOR WALL PANEL ARRANGEMENT

(75) Inventors: Nicholas Fricano, Grand Haven, MI (US); Richard Dixon, Zeeland, MI (US); Mark R. Smith, Zeeland, MI (US); Jonathan R. DeYoung, Grand Rapids, MI (US); Scott J. Leenstra, Caledonia, MI (US)

(73) Assignees: Haworth, Inc., Holland, MI (US); Innotec Corporation, Zeeland, MI (US)

( * ) Notice: Subject to any disclaimer, the term of this patent is extended or adjusted under 35 U.S.C. 154(b) by 30 days.

(21) Appl. No.: 10/134,043

(22) Filed: Apr. 26, 2002

(65) Prior Publication Data

US 2003/0201075 A1 Oct. 30, 2003

(51) Int. Cl.[7] ..... A47G 5/00

(52) U.S. Cl. ..... 160/135; 211/187; 211/208; 52/239

(58) Field of Search ..... 160/135; 211/187, 211/191, 208; 248/220.31; 52/239, 481.2, 582.1

(56) References Cited

U.S. PATENT DOCUMENTS 3,168,200 A * 2/1965 Larson ..... 211/194
3,349,535 A * 10/1967 Balinski ..... 52/634
3,452,959 A * 7/1969 Ishikawa ..... 248/488
3,602,472 A * 8/1971 Smyth-Tyrrell ..... 248/242
3,733,755 A * 5/1973 Butler ..... 52/36.6
3,791,528 A * 2/1974 Brendgord ..... 211/88.01
3,908,831 A * 9/1975 Brendgord ..... 211/88.01
4,086,978 A 5/1978 Clements
RE31,733 E * 11/1984 Haworth et al. ..... 439/31
5,795,501 A * 8/1998 Kano ..... 252/514
6,112,485 A * 9/2000 Beyer et al. ..... 52/239
6,256,941 B1 * 7/2001 Yu et al. ..... 52/144

* cited by examiner

*Primary Examiner*—Blair M. Johnson
(74) *Attorney, Agent, or Firm*—Flynn, Thiel, Boutell & Tanis, P.C.

(57) ABSTRACT

An upright connector or support post usable in a space-dividing wall panel system formed from serially connected panel assemblies. The post includes a plurality of openings disposed in vertically spaced relation with one another which receive load-bearing elements such as hangers or hooks typically associated with furniture components. Dimples or deformations extend transversely along the upper and lower edges of the openings and provide increased strength at the attachment points along the post.

32 Claims, 6 Drawing Sheets

REINFORCED SUPPORT ELEMENT FOR WALL PANEL ARRANGEMENT

FIELD OF THE INVENTION

This invention relates to an upright support element or post defining an attachment point for a load-bearing hanger-type connector, which may be utilized in a space-dividing wall panel system.

BACKGROUND OF THE INVENTION

Numerous wall panel systems have been developed for use in dividing large open office areas into smaller work spaces. The wall panel system is typically formed from a plurality of individual upright wall panels which are appropriately joined together either directly or through intermediate connecting structures, such as upright connectors or support posts. The wall panels are appropriately arranged into desired geometrical configurations to define work spaces for individual occupants. In this regard, the individual wall panels conventionally join in aligned relationship, and also traditionally connect at corners which define two, three or four-panel connections. Such wall panels are typically less than floor-to-ceiling height, and cooperate with other furniture components to define an equipped workstation. These components may include worksurfaces, file cabinets, shelf units and the like which mount directly on and are supported by the wall panels, and may also include freestanding furniture components such as tables, chairs and file cabinets.

In known panel arrangements, the individual panel assemblies have a variety of configurations. For example, in some arrangements, the individual panels are supported directly in load-bearing relationship with a floor by support feet or glides. In other arrangements, serially-adjacent panel assemblies are interconnected through intermediate upright supports or connector posts which bear the weight of the panels and in turn are maintained in load-bearing engagement with the floor. The present invention is concerned with improvements in the latter type of panel arrangement, but is equally applicable to various types of structures which utilize an upright support element defining an attachment point for securement of a component by means of a load-bearing hanger-type connecting structure. These types of structures may include scaffolding, shelves, racks, or even enclosures of the temporary type.

In wall panel arrangements which utilize intermediate support elements or posts between serially-adjacent wall panels, the individual posts are typically tubular in configuration and include a plurality of openings which communicate with the hollow interior of the post. These openings are disposed in vertically spaced relation with one another along the length of the post and receive therein hangers or hooks associated with office-type accessories, such as shelving, storage units and the like, which are to be mounted to the upright panel assembly. These openings may also accommodate hangers of cover pads or panels which are secured between a pair of adjacent posts in stackable-type panel systems.

U.S. Pat. No. 6,112,485 discloses such a support post designed to connect between upright side frame members of two adjacent wall panel assemblies. The post is defined by a pair of U-shaped channel members positioned in opposed relation so that the respective legs thereof overlap one another on opposite sides of the post. The overlapped legs are then welded to fix the channel members to one another. These overlapped areas of the two opposed channel members define therein a vertical row of openings for accommodating hangers. Thus, the load-bearing areas of the post adjacent the hanger-receiving openings are reinforced due to the double-wall construction of the post at these openings. However, the two-piece construction of the post and the double wall configuration along the two side walls thereof is costly from a manufacturing standpoint with respect to materials and assembly, and also results in increased weight of the post.

Accordingly, it is an object of the invention to provide an improved structural support or post capable of accommodating a load-bearing element associated with a component to be mounted on the post, which post utilizes a one-piece thinner wall construction to reduce materials, weight and assembly time, yet provides significant load-bearing capabilities at the load bearing points along the post.

More specifically, the post according to the invention is of a one-piece tubular construction with a continuous side wall, which is preferably formed by roll-forming. The post includes a pair of opposed side walls, each of which defines therein a row of vertically spaced hanger-receiving openings. The side walls are deformed during manufacturing to define an inwardly projecting dimple disposed along a load-bearing edge of each of the respective openings. The dimples accordingly provide increased strength at the attachment points along the post, and effectively increase the wall thickness of the post adjacent the openings so as to accommodate standard mounting hangers or hooks associated with office-type accessories or other elements to be supported on the post.

The post according to the invention may be utilized in a space-dividing wall panel arrangement which mounts on and projects upwardly from a floor for dividing an open area into a plurality of smaller working areas. In this regard, the post is disposed in load-bearing relation with the floor and interconnects two serially-adjacent panel assemblies to one another. The post is sandwiched between the upright edges or edge frames of the respective panel assemblies so that the vertical rows of hanger-receiving openings are exposed for receiving conventional hangers associated with furniture components such as cabinets or the like. Alternatively, the post can mount thereon cover pads typically associated with stackable-type panel systems, wherein the cover pads are mounted between two adjacent upright posts by inserting the hangers or connectors disposed along the opposite upright edges of the cover pad into the openings defined in the outwardly facing sides of the adjacent horizontally-spaced posts.

It will be appreciated that the post according to the invention may also be utilized in other types of structures which incorporate an upright support which defines at least one attachment point therealong for connection to a further load-bearing component.

Other objects and purposes of the invention will be apparent to persons familiar with arrangements of this general type upon reading the following specification and inspecting the accompanying drawings.

Figure 1:
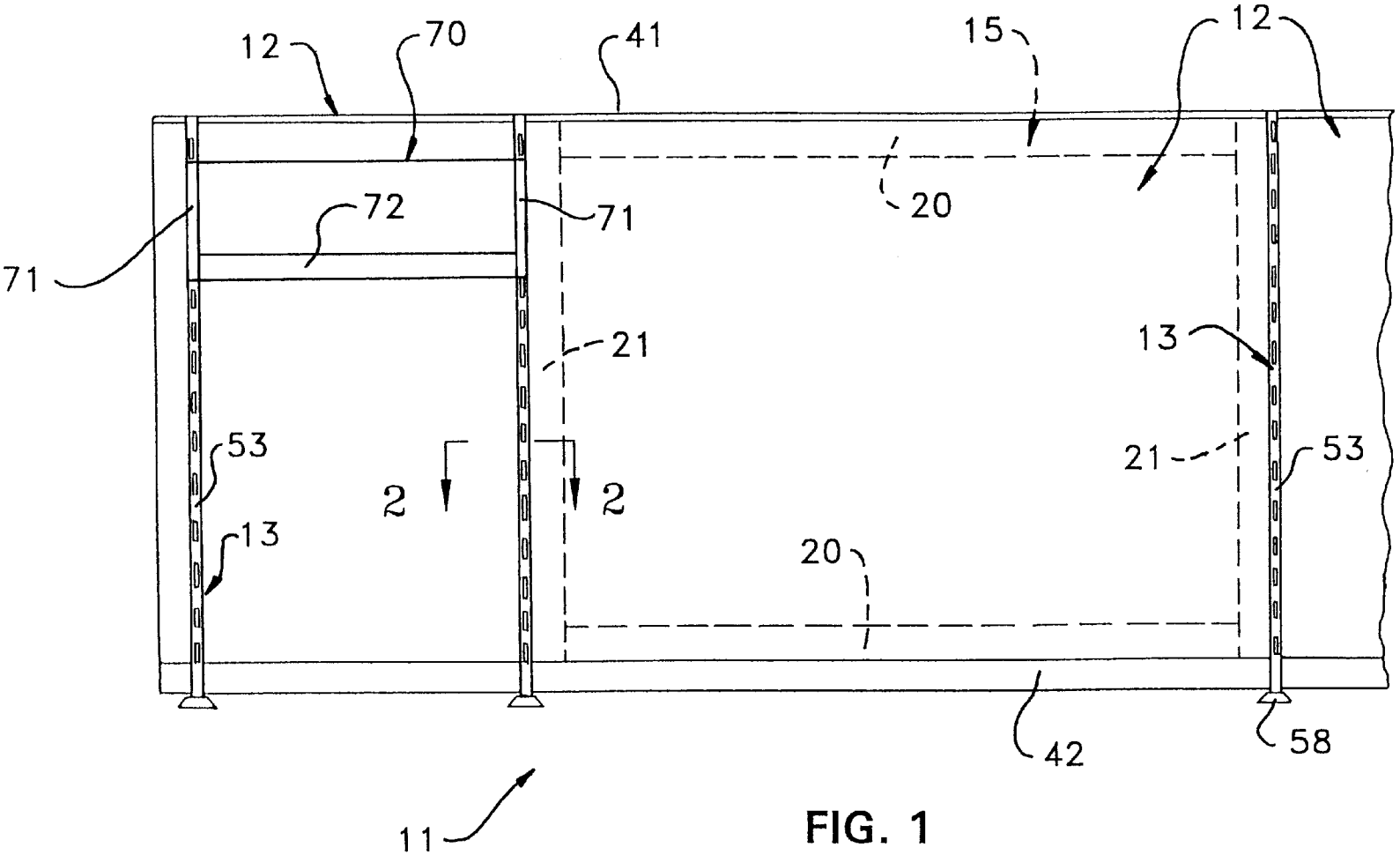
FIG. 1 is a side elevational view which illustrates several panel assemblies joined together to define at least part of an upright space-dividing wall system according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated an upright space-dividing wall system 11, which system 11 is formed from a plurality of upright space-dividing panel assemblies 12 joined together in a series arrangement to define individual workstations. The panel assemblies 12 are typically joined in either aligned (i.e. end-to-end) relationship, or in perpendicular relationship with end edges of two panel assemblies 12 being disposed closely adjacent one another, such arrangements being conventional. The individual panel assemblies 12 typically have a height which is significantly less than floor-to-ceiling height, whereby the panel assemblies 12 are supported on and project upwardly from the floor, with upper edges of the panel assemblies 12 being spaced downwardly a significant distance from the ceiling. The sizes of such panel assemblies 12, in terms of widths and heights, are conventional. In the illustrated space-dividing wall system 11, each pair of adjacent aligned panel assemblies 12 is connected together by a post-type connector arrangement 13, as discussed below.

Each panel assembly 12 has large width and height dimensions as compared to the thickness dimension thereof, and includes a generally rectangular and ring-like frame 15 defined by generally parallel and horizontally elongated top and bottom frame members or rails 20 which are rigidly joined together at opposite ends thereof by generally parallel and vertically elongated side frame members or rails 21. The frame members 20 and 21, in accordance with the illustrated embodiment, are each of generally identical or similar cross-section, and are of a generally outwardly-opening channel-like configuration. For simplicity, only side frame members 21 are illustrated and discussed below.

Figure 2:
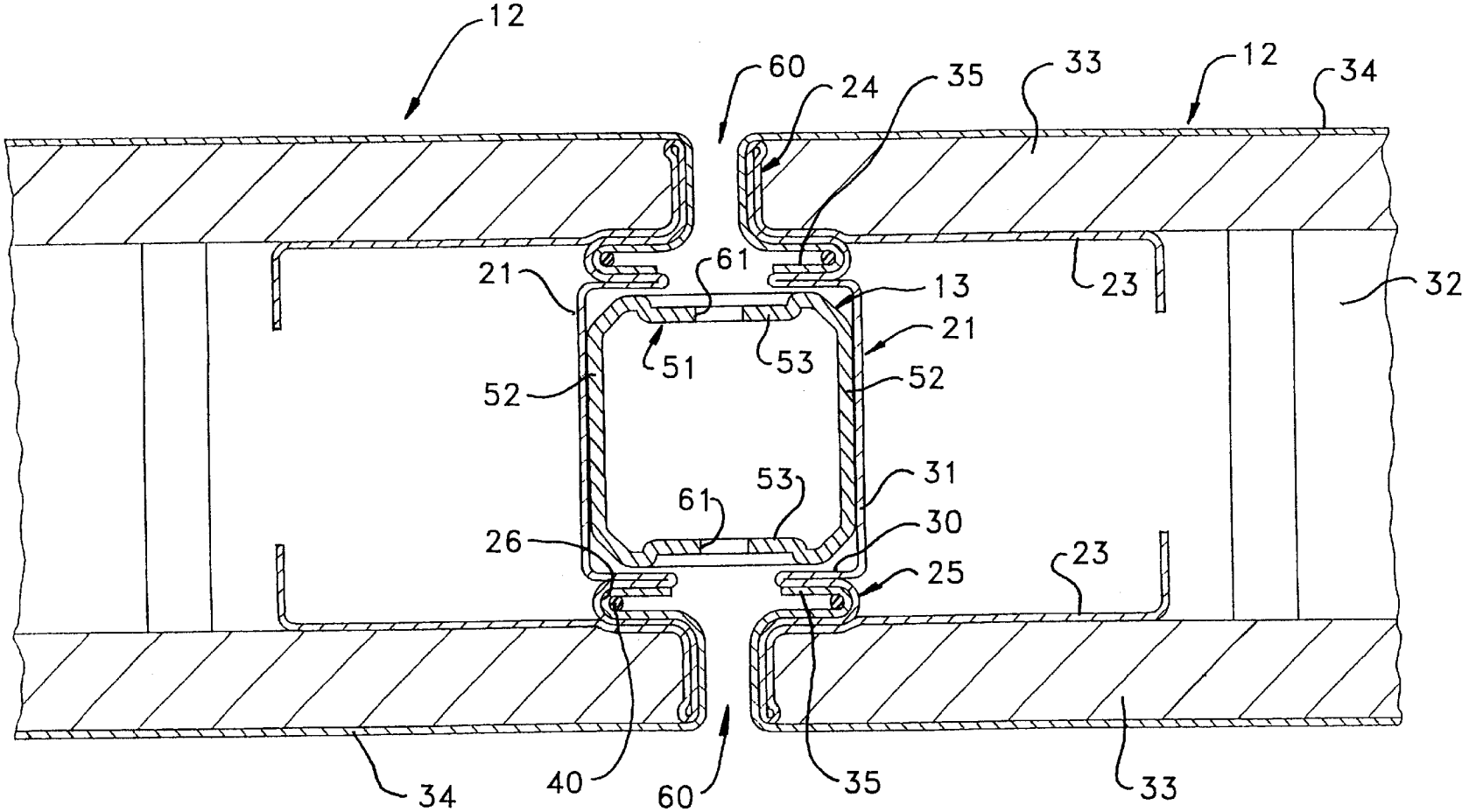
FIG. 2 is an enlarged, fragmentary cross-sectional view taken generally along line 2—2 in FIG. 1.

With reference to FIG. 2 which illustrates two adjacent side frame members 21, each frame member 21 includes a pair of generally parallel side walls 23. Each side wall 23, at an outermost edge thereof, is bent outwardly through about a 90° angle to form a flange 24 which defines the end edge of the panel assembly 12. The flanges 24 extend along all of the frame members 20 and 21 and hence define a generally rectangular ring-like rim. Each flange 24 is in turn joined to a generally U-shaped shaped part 25 which is spaced sidewardly and inwardly from the respective flange 24. U-shaped parts 25 define therein a channel or groove 26 which extends throughout the elongated length of the respective frame member and opens outwardly. Each U-shaped part 25 is bent over upon itself to form a wall 30 generally parallel to side walls 23, and an outer wall 31 extends between and interconnects the walls 30. Outer wall 31 and walls 30 together define an outwardly-opening mouth or channel.

The ring-like frame 15, as defined by the frame members 20 and 21, surrounds and confines a core structure 32 which fills the interior of frame 15 (FIG. 2). The core structure 32 in the illustrated embodiment comprises a sheet of paper or expanded honeycomb, although other conventional core materials can be utilized if desired. The frame 15 and core structure 32 are sandwiched between a pair of plate-like side members 33, the latter being of generally rectangular configuration so as to cover substantially the entire opposite sides of the panel assembly 12. The side members 33 directly overlie and are preferably adhesively secured to opposite side surfaces of the frame members 20 and 21 (i.e. side walls 23) and core structure 32, with the edges of the side members 33 being confined generally within the rim defined by the flanges 24, as illustrated in FIG. 2. These flanges 24 project sidewardly through a distance which substantially corresponds to the thickness of the side members 33.

The plate-like side members 33 in the illustrated embodiment are of a one-piece lamina of what is conventionally referred to as mineral or fiberboard. This fiberboard provides a relatively rigid and stiff lamina but possesses physical properties which enable it to function in a highly desirable manner as a tack board. The fiberboard additionally provides desirable acoustical properties, and specifically sound-absorption properties. The side members 33 are preferably covered by a thin layer of fiberglass (not shown), typically of lesser thickness than the side member 33, which fiberglass layer extends over the outer surface of the side member 33.

The panel assembly 12 is additionally provided with exterior coverings over the laminate defined by the side members 33 and the fiberglass layers, which coverings in the illustrated embodiment comprise large sheets of thin but flexible fabric 34 which are stretched across and entirely cover the outer vertical side faces of the panel assembly. This fabric sheet 34 has edge portions 35 which wrap exteriorly around each of the frame member flanges 24 and fold into the groove 26, with the fabric edge portion 35 being suitably secured within groove 26 by a retaining element 40, as is conventional.

As shown in FIG. 1, the top of the panel assembly 12 can have a top cap 41 which spans the width of the top edge of the panel assembly 12 and closes off the mouth defined therein. The lower edge of the panel assembly 12 may also include a raceway arrangement 42 which defines an interior channel and extends lengthwise along the lower edge of the respective panel assembly 12. It will be appreciated that cabling may be stored or disposed within this interior channel of the raceway arrangement 42, and also within the hollow areas of the top and side frame members 20 and 21, as is conventional.

Figure 5:
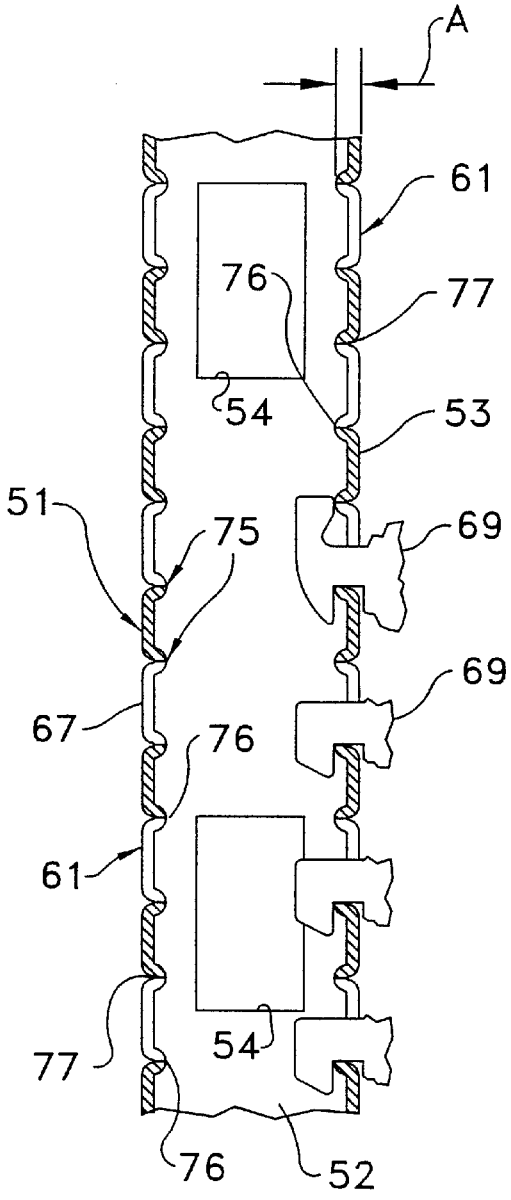
FIG. 5 is an enlarged, fragmentary cross-sectional view taken generally along line 5—5 in FIG. 4.
Figure 4:
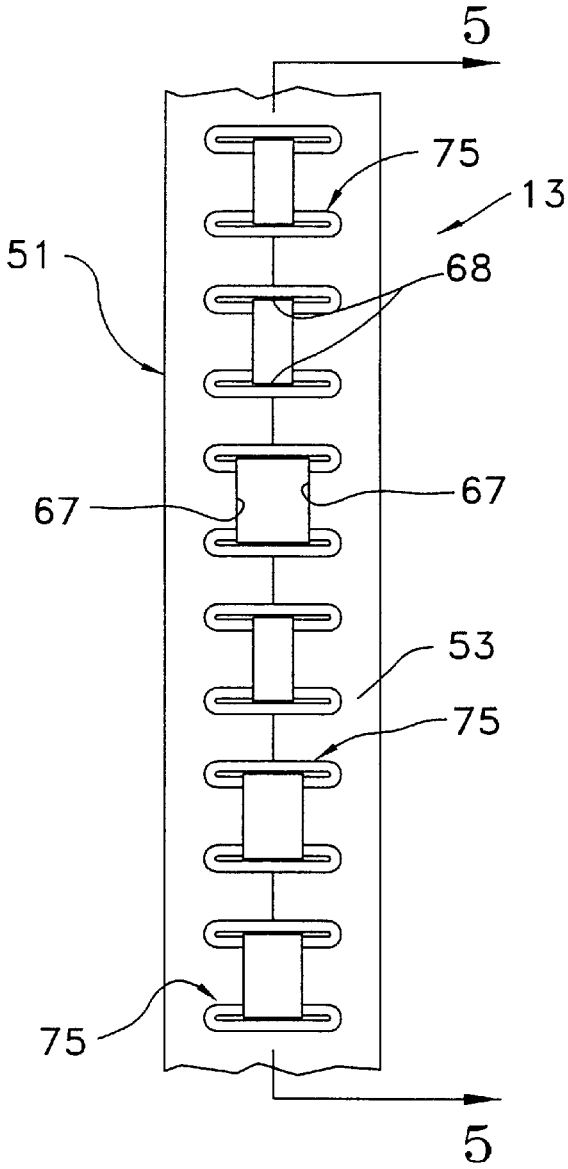
FIG. 4 is an enlarged, fragmentary detail view of the outwardly facing side of the support post illustrated in FIG. 3.

Considering now the post-type connector arrangement 13, this arrangement 13 includes a vertically elongate and generally tubular support element or post 51, which is designed to connect between the side frame members 21 of two adjacent panel assemblies 12 as discussed below. The post 51 in the illustrated embodiment includes a pair of generally parallel side walls 52 which face the respective side frame members 21 of two serially adjacent panel assemblies 12 when the post 51 is interposed therebetween, and two face walls 53 which extend transversely between and interconnect the side walls 52. Each of the side walls 52 define therein a pair of vertically spaced openings 54 at least adjacent the upper ends thereof (FIG. 5). The openings 54 in the opposed side walls 52 are horizontally aligned with one another and are utilized to interconnect the respective panel assemblies 12 to the post 51 as discussed further below.

Figure 3:
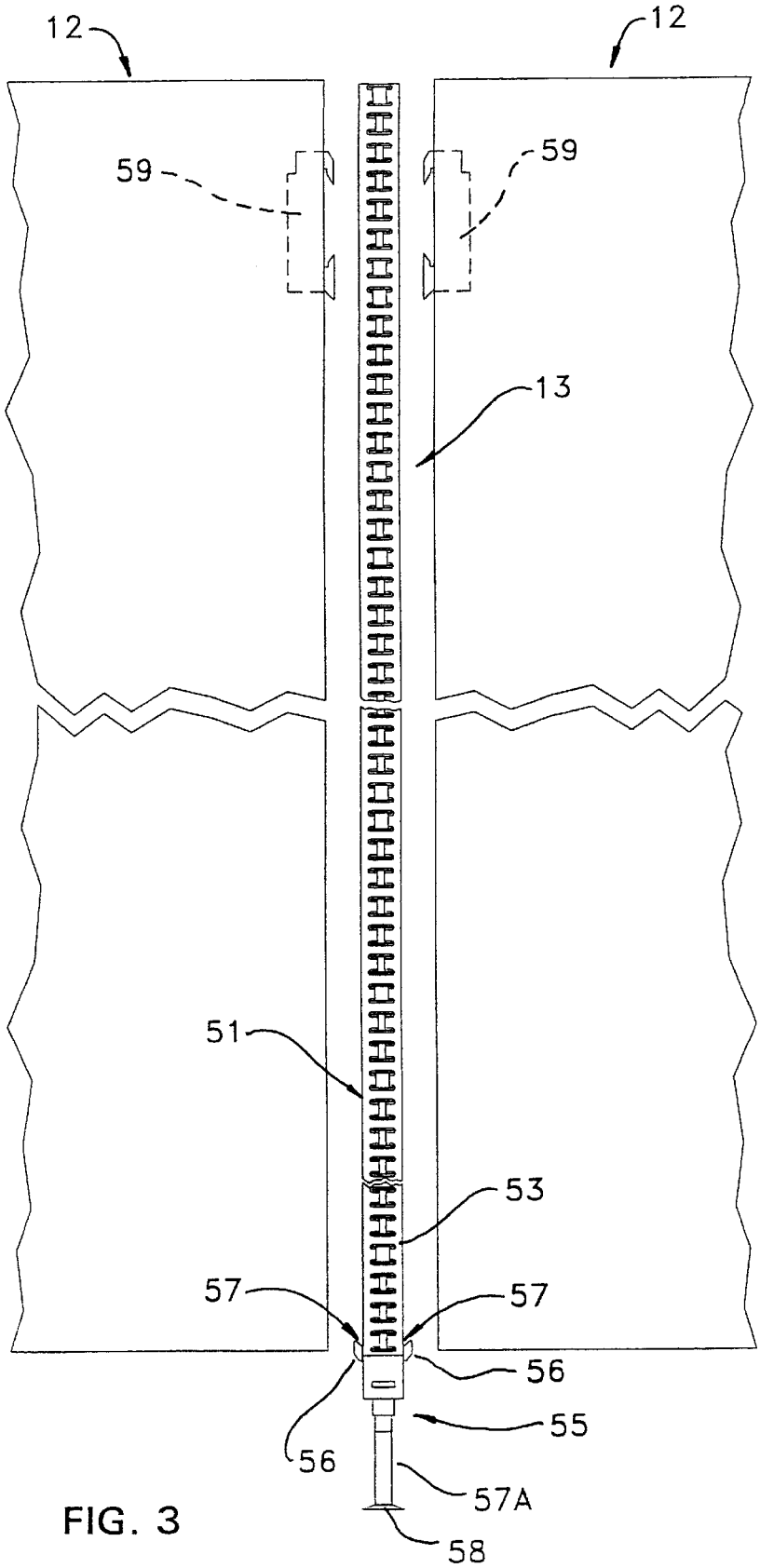
FIG. 3 is an enlarged, fragmentary, exploded side elevational view of two adjacent panel assemblies and an intermediate support post.

As shown in FIG. 3, the post 51 has a lower end or foot 55 which mounts thereon a pair of arms or connectors 56 which extend outwardly and upwardly from the respective side walls 52 of the post 51. These connectors 56 respectively define generally horizontally extending and upwardly opening channels 57 on opposite sides of the post 51. The lower end 55 additionally includes a downwardly projecting rod 57A having its lower end fixed to an enlarged foot or glide 58 adapted for direct supportive engagement with the floor. The rod 57A can threadingly engage within an opening in the foot 55 so as to allow for height adjustment of the post 51 relative to the glide 58.

A panel lock or connector 59 is supported on each of the panel assemblies 12 adjacent the upper corners thereof, as shown in FIG. 3.

To secure two or more panel assemblies 12 in aligned series relationship as shown in FIG. 1, a single connector post 51 is provided and cooperates directly between the adjacent upright end edges of two panel assemblies 12 to rigidly join same to one another. The lower corners of the panel assemblies 12 are seated within the respective channels 57 of foot 55 and the upper edges of the panel assemblies 12 are secured to the respective side walls 52 of post 51 by the panel locks 59. The attachment of the respective panel assemblies 12 to the connector post 51 is described in detail in U.S. Pat. No. 6,112,485 (which is hereby incorporated by reference in its entirety herein). It will be appreciated that other types of connections may be utilized to secure panel assemblies 12 to post 51.

With each pair of aligned panel assemblies 12 joined through a single connector post 51, the post 51 is sandwiched within a generally rectangular opening defined by the sidewardly opening mouths of the respective side frame members 21 of the two adjacent panel assemblies 12 so as to be effectively hidden between the panel assemblies 12, the latter having the vertical end edges thereof disposed closely adjacent and separated from one another by a vertically extending clearance gap or slot 60, as illustrated in FIG. 2. In this regard, the face walls 53 of post 51 each define therein a plurality of slot-like openings 61 extending therethrough and providing access into the hollow interior of post 51. The slot-like openings 61 are vertically elongated and are vertically spaced from one another along substantially the entire vertical extent of post 51, and each opening 61 is defined by a pair of upright and generally parallel side edges 67 and a pair of generally horizontal and generally parallel top and bottom edges 68 which extend transversely between the respective side edges 67. With the post 51 interposed between adjacent panel assemblies 12 as discussed above, the gap 60 is directly aligned with the slot-like openings 61 provided in the support post 51 so that conventional hangers 69 (see FIG. 5) associated with furniture components or accessories such as cabinets can be positioned adjacent the side surface of the panel assembly 12, with the hangers 69 of the accessory projecting through the gap 60 for engagement within corresponding openings 61. As such, the weight of the components is transmitted directly to the panel connecting posts 51 which in turn directly supportingly engage the floor, and hence the weight or load of the accessories is not imposed on the panel assemblies 12.

FIG. 1 illustrates a conventional shelf unit 70 which may be utilized with the present invention. The illustrated shelf unit 70 includes a pair of upright end walls 71 and a generally horizontally oriented shelf 72 which extends between and interconnects the end walls 71. The rearwardly facing sides of each of the end walls 71 mount thereon hangers 69 which project rearwardly and are vertically spaced from one another as shown in FIG. 5. The hangers 69 of the shelf unit 70 at each end thereof engage within corresponding openings 61 of two serially adjacent posts 51 so that the shelf unit 70 extends transversely between the posts 51 and is positioned so as to project sidewardly from the vertical side surface of the panel assembly 12. It will be appreciated that other components may be mounted on panel assembly 12, such as a worksurface or a cabinet. These components would be mounted in a manner similar to that described above with respect to shelf unit 70.

With reference to FIGS. 4–7, the post 51 according to the invention incorporates therein an improved arrangement which provides reinforcement at or adjacent the load-bearing areas therealong. More specifically, the post 51 defines dimples or deformed areas 75 therein which extend transversely across both the upper and lower edges 68 of each opening 61. As shown in FIG. 5, the inward deformation or dimpling of the material of the face wall 53 of the post 51 results in inwardly projecting ribs 76 which extend linearly and transversely across the face wall 53 along the top and bottom edges 68 of each slot-like opening 61. The ribs 76 project inwardly into the hollow interior of the post 51, and thus a transversely extending recess 77 is defined along the outer side of the post 51 opposite each of the ribs 76. In the preferred embodiment, the dimples 75 extend sidewardly beyond the vertical side edges 67 of each of the respective openings 61, and each dimple 75 has a horizontal length which is significantly greater than half of the horizontal width of the post 51 as measured between vertical edges of the respective face walls 53 thereof. As shown in FIG. 5, the inwardly projecting ribs 76 are formed closely adjacent the respective openings 61 so as to define the respective top and bottom edges 68 thereof.

The inwardly projecting ribs 76 effectively increase the wall thickness A (FIG. 5) of the respective face walls 53 along the upper and lower edges of each of the openings 61, and the thickness A is approximately twice as great as the thickness of the post in non-dimpled areas. In this regard, the post illustrated in U.S. Pat. No. 6,112,485 has a greater wall thickness at the slot-like openings due to the double-wall construction of the post adjacent these openings, as discussed above. Thus, the post 51 provided with the dimples according to the invention has a wall thickness adjacent the openings 61 which is equivalent to the post of the '485 patent, which allows the post 51 to accommodate the slot width of standardized accessory hangers 69.

It will be appreciated that the post 51 pursuant to the invention is also suitable for attachment to panel assemblies 12 of different heights, simply by providing additional pairs of upper and lower openings 54 in post 51 at the appropriate height to accommodate standard panel heights.

The post 51 according to the invention may also be utilized with stackable-type panel systems, such as that disclosed in U.S. Pat. Nos. 6,349,516 and 5,806,258, which are hereby incorporated by reference herein in their entirety. The panel system disclosed in the '516 patent includes at least one base panel which is supported on opposite ends thereof by a pair of upright lower support posts. To increase the height of the wall, one or more extension panel assemblies are stacked atop the base panel. More specifically, in order to build up a base panel, a pair of extension posts or poles are coaxially inserted within open upper ends of the respective lower support posts, and a cross rail is connected between the spaced-apart pair of extension posts. Cover pads are then mounted to the frame defined by the support posts and cross rails. The lower ends of the extension posts each define thereon a bayonet-type connector which engages within the open upper end of the lower support post such that the extension post extends upwardly therefrom.

It will be appreciated that the post 51 according to the invention may be utilized as a lower support post in a stackable-type system, or as an extension post. In the latter case, the foot 55 would obviously be omitted and a bayonet connector provided in place thereof.

Figure 6:
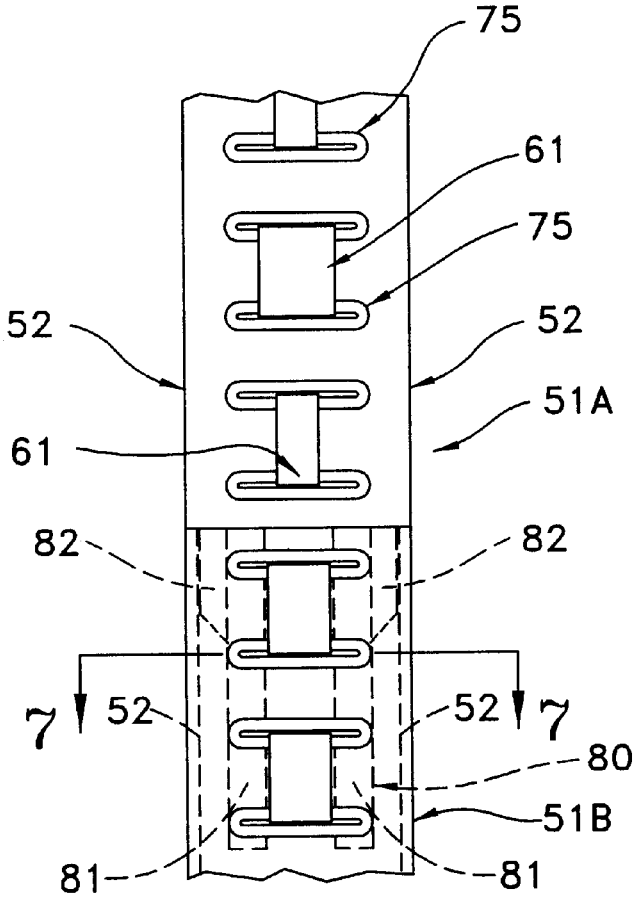
FIG. 6 is an enlarged, fragmentary view illustrating a bayonet-type connection.
Figure 7:
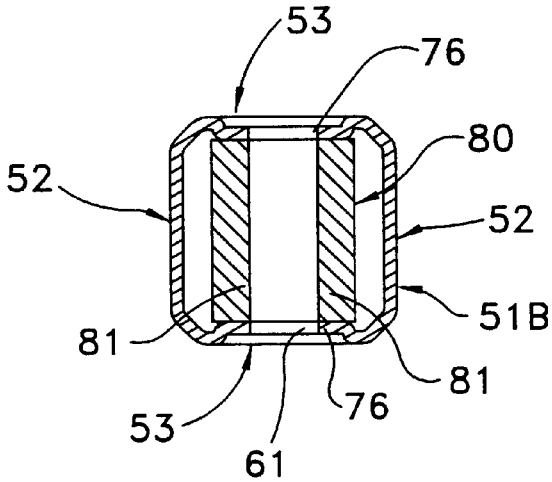
FIG. 7 is an enlarged cross-sectional view taken generally along line 7—7 in FIG. 6.

More specifically, FIG. 6 illustrates a pair of vertically-stacked posts 51A and 51B configured with dimples 75 according to the invention, wherein the posts 51A and 51B may represent an extension post and a lower support post, respectively, or alternatively a pair of extension posts which permit vertical extension of a lower support post. As shown in dotted lines in FIG. 6, the upper post 51A mounts thereon a bayonet connector 80 defined by a pair of generally parallel and downwardly projecting flanges 81. The flanges 81 of connector 80 extend downwardly into the open upper end of lower post 51B so that same are generally parallel to the respective side walls 52 of lower post 51B and extend transversely between the ribs 76 of the opposed face walls 53 thereof. FIG. 6 also illustrates a pair of cams 82 provided at the upper ends of the respective flanges 81 which serve to align the upper and lower posts 51A and 51B with one another and correctly center the flanges 81 of upper post 51A within the lower post 51B so that the flanges 81 are correctly positioned between the opposed ribs 76 of lower post 51B. In this regard, the inward projection of ribs 76 and also the transverse extension of each of the dimples 75 across the majority of the width of the respective face walls 53 permits snug engagement of the bayonet connector 80 of the upper post 51A within lower post 51B.

The slot-like openings 61 of post 51 can be utilized for mounting hooks or hangers associated with the cross rail of the extension panel assembly illustrated in the '516 and '258 patents, and also to mount hooks associated with cover pads which are typically utilized in stackable-type panel arrangements, such as that illustrated in U.S. Pat. No. 6,256,941, also incorporated by reference herein in its entirety.

It will also be understood that for certain applications, it may be necessary to include a deformation or dimple 75 adjacent only one edge of the slot-like opening 61, for example the lower edge. However, providing dimples 75 adjacent both the upper and lower edges 68 of the openings 61 can simplify assembly, in that no particular attention need be paid to the specific orientation of the post. Further, in many wall panel systems, panel-mountable components, and specifically those required to bear significant loads (i.e. worksurfaces), often include an uppermost hanger which includes both downwardly and upwardly projecting hooks thereon (see FIG. 5). The upwardly projecting hook on the uppermost hanger is intended to prevent inadvertent dislodgement of the component from the panel due to an upwardly directed force. Because both the upper and lower hooks of the uppermost hanger engage the face wall of the post 51, dimpling at the upper and lower edges of the openings 61 is desirable.

It will be understood that the post 51 according to the invention may be utilized in arrangements other than a space-dividing wall system. For example, the post may form part of a rack or shelf system, or in scaffolding arrangements which typically utilize upright supports which in turn permit attachment of horizontal supports thereto. The instant invention may also be utilized in temporary-type enclosed structures, such as stands, booths, etc.

The post 51 according to the invention is a one-piece, roll-formed tube having a continuous sidewall construction as defined by the side and face walls 52 and 53, and less material is therefore required to form the post which in turn reduces manufacturing costs. While the post 51 has a thinner wall due to the continuous wall construction preferably formed in one-piece by being roll-formed from thin flat sheet steel, the dimples 75 provide the post 51 with increased strength and rigidity at the load-bearing openings 61.

Figure 8:
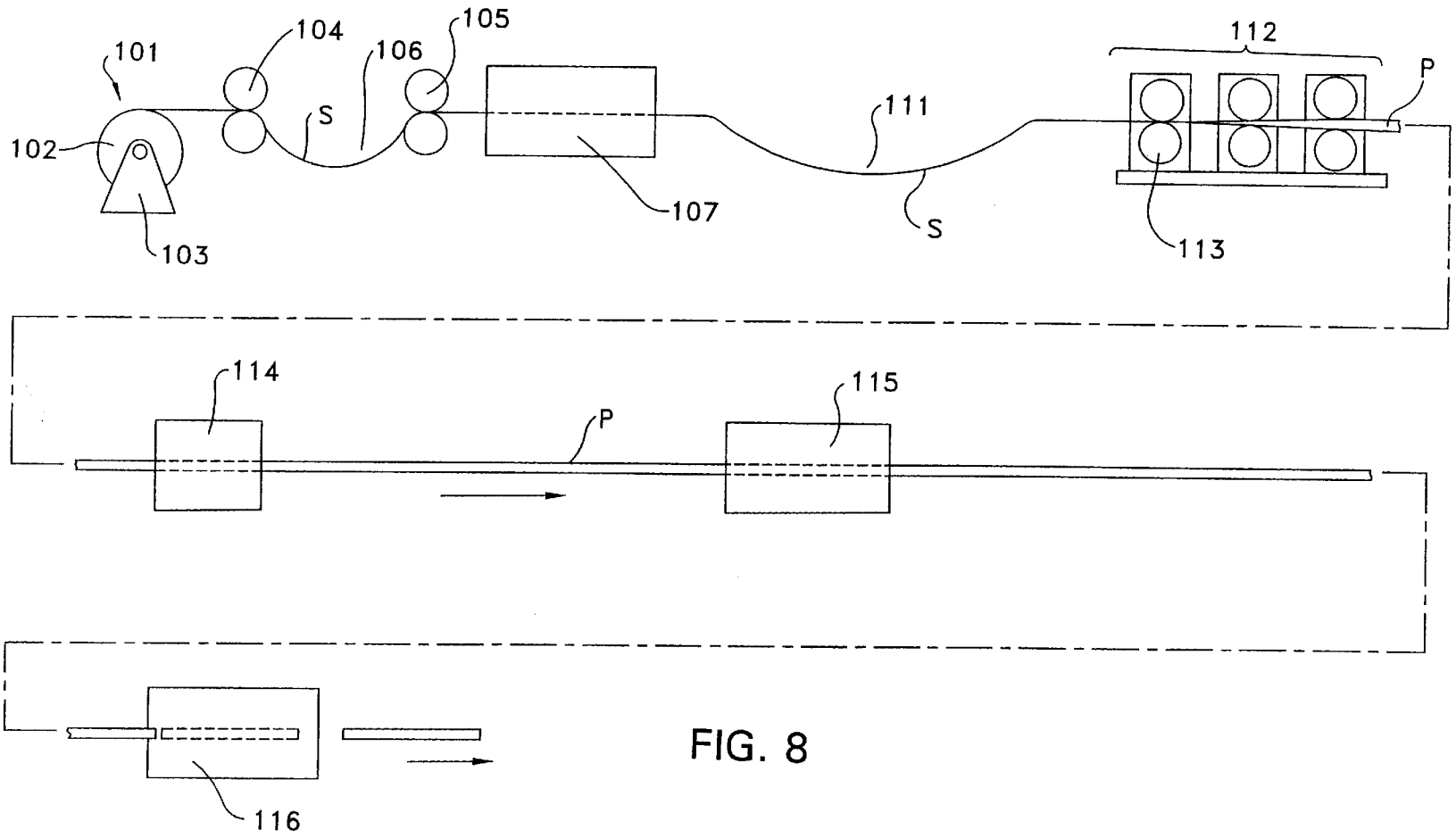
FIG. 8 is a diagrammatical illustration of a forming process and apparatus which may be utilized to form the post according to the present invention, which shows the process and apparatus from one side of the initially supplied steel sheet.

The elongate tubular post of the present invention is preferably formed from a flat steel sheet utilizing a roll forming process, as diagrammatically illustrated in FIG. 8, so that the resulting tubular post hence is of substantially uniform thickness throughout and yet is free of or has only minimal internal stresses of the type which result from more conventional metal stamping or die forming processes typically used to form posts of this type. It will be appreciated that the post according to the invention has a uniform wall thickness throughout, and as shown in FIG. 5, the wall thickness of the post at the dimpled areas is uniform with the wall thickness in non-dimpled areas.

Referring to FIG. 8, there is typically provided a supply station 101 for supplying sheet steel, preferably a substantially continuous and elongate strip of sheet steel S. The sheet steel at supply station 101 is typically provided in the form of a conventional coil 102 wherein the sheet steel is effectively spirally wound, with the coil being appropriately rotatably supported on a conventional coil stand 103. The thin and relatively flexible sheet steel S is withdrawn from the coil 102 by a drive device 104, which can also function to effect straightening of the sheet steel. A further drive device 105 is spaced downstream from the drive 104 and is separated therefrom to define a takeup region 106 which enables a suspended loop of sheet metal to be formed therebetween to compensate for different driving speeds of the sheet metal by the drives 104 and 105. The drive device 105 in turn drives the sheet steel S into and through a working station 107, such as a punch press or the like, which effects forming of all openings and notches, as well as any cuts or slits, in the flat sheet S. The steel sheet S is momentarily stopped during closure of the punch press 107 so that this press simultaneously effects forming of all of the openings and notches associated with the entire post, and in addition effects forming of the dimples 75 adjacent the opposite edges of the slot-like openings 61.

Upon opening of the punch press 107, the sheet steel S is advanced toward a conventional roll-forming mill 112 which includes a plurality of sequential rolling stations 113 disposed in adjacent relationship along the downstream moving direction of the sheet S. Each station 113 typically includes opposed upper and lower forming rollers which engage opposite sides of the sheet S to progressively deform the sheet S from its flat condition into the desired three-dimensional shape or profile. The roll-forming mill 112 with its rollers pulls the sheet steel S into and through the rolling stations 113 at a substantially constant rate and the intermittent driving of the sheet S upstream of the punch press 107 by drive device 105 causes the formation of a further takeup loop 111 between punch press 107 and rolling mill 112. In the present invention the rolling mill 112 progressively deforms the sheet which, when fed into the first station of the mill is of a relatively flat sheet-like configuration, into a three-dimensional configuration which, upon leaving the mill, has a generally closed tubular cross-section or profile substantially as described above. The formed, nonflat three-dimensional profile as it departs the rolling mill is designated P in FIG. 8 since the steel sheet is no longer flat.

Upon departing the rolling mill 112, the formed three-dimensional profile P having a substantially tubular cross-section is then fed continuously into and through a welding station 114 which effects forming of a continuous seam weld along the abutting edges of the roll-formed closed tubular profile, which seam is preferably positioned in the vicinity of one of the corners of the profile. The welded profile P is then forwarded in a continuous manner into and through a surface treating station 115, which may effect either painting or powder coating of the continuous profile P as it moves into and through the station 115. Such surface treating equipment is conventional and well known. The painted or coated continuous profile P is then moved in a continuous manner into a cutting station 116 which sequentially causes the continuous profile P to be transversely cut or severed into individual elongate workpieces which define the desired finished post.

With the process of this invention as briefly described above, a large number of identical posts can be rapidly and efficiently formed with a high degree of accuracy, and at the same time the closed tubular configuration of the post provides desirable strength and rigidity while permitting the wall thickness of the post to be minimized, thereby providing economy of manufacture. When a post of a different length is desired, then the punch press 107 is adjusted so as to permit punching of a profile corresponding to a post of desired length, with the remainder of the process being otherwise identical to the process as summarized above. The punch press 107 can be defined by a plurality of modules which can be readily connected or disconnected so as to define a punching pattern corresponding to a family of different post lengths.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A space-dividing wall system comprising:

first and second portable upright panel assemblies each having a vertically elongate upright end edge and a pair of oppositely facing and generally planar vertically oriented side surfaces which extend transversely relative to the respective said end edges; and a vertically elongate support element interposed between the respective end edges of said first and second panel assemblies and having a pair of vertically elongate and oppositely facing walls, each of said walls defining therein a plurality of openings disposed in vertically spaced relation with one another for respectively receiving load-bearing connectors associated with a furniture component, wherein at least one edge of each said opening is deformed to define an inwardly projecting dimple which extends transversely along said one edge relative to the elongated direction of said post to reinforce said post adjacent said openings thereof.

2. The wall system of claim 1 wherein a said dimple is defined adjacent both upper and lower edges of each said opening, said dimples being vertically spaced from one another along said support element.

3. The wall panel system of claim 1 wherein said post is of a one-piece roll-formed construction having a generally tubular shape defined by a continuous wall structure, said walls being integral with and forming part of said continuous wall structure.

4. The wall panel system of claim 3 wherein a said dimple is defined adjacent both upper and lower edges of each said opening, said dimples being parallel with one another and horizontally elongated so as to extend beyond the horizontal width of the respective opening as defined between a pair of generally upright edges thereof.

5. The wall panel system of claim 3 wherein said walls comprise face walls which face towards opposite sides of the respective first and second panel assemblies, and a pair of side walls extend transversely between and interconnect the respective face walls, said side walls being integral with and forming part of said continuous wall structure, said side walls being respectively disposed adjacent said end edges of said first and second panel assemblies.

6. The wall panel system of claim 1 wherein said dimples extend transversely across a substantial portion of a width of said support element as defined horizontally between upright vertical end edges of the corresponding wall thereof.

7. The wall panel system of claim 1 wherein said openings have a vertically elongate rectangular configuration defined by generally parallel and horizontal upper and lower edges and a pair of generally parallel and vertical side edges which extend between said upper and lower edges, each said dimple being oriented perpendicularly relative to the respective side edges and extending horizontally beyond same.

8. The wall system of claim 1 wherein said support element has a lower end disposed in supportive engagement with a floor.

9. A space-dividing wall panel system comprising:

a pair of upright, vertically elongate and laterally spaced support posts each having a lower end disposed in supportive engagement with a floor, each said support post having a tubular configuration defining a generally hollow interior and an outwardly facing side wall defining therein a plurality of vertically spaced openings, each of said openings having a lower edge having a deformed area defining a rib which extends generally horizontally on said lower edge of each of said openings and laterally beyond the ends of said lower edge to reinforce same;

a panel assembly disposed between and supported on said support posts and defining a generally vertically oriented side surface; and a pair of laterally-spaced and generally hook-shaped elements, one of said elements being engaged within a said opening of one of said support posts and the other said element being engaged within a said opening of the other said support post; and a furniture component positioned adjacent said side surface of said panel assembly and extending between and connected to said elements for support from said posts.

10. The panel system of claim 9 wherein each said support post is of a one-piece, monolithic roll-formed construction having a continuous side wall structure, said side walls being integral with and forming part of said side wall structure.

11. The panel system of claim 9 wherein said ribs project inwardly into said hollow interior of the respective support post to provide said side wall with a greater horizontal thickness.

12. An upright space-dividing wall panel assembly comprising:

a pair of generally vertically oriented and generally planar side surfaces and a pair of sidewardly-spaced upright end portions oriented transversely relative to said side surfaces;

a pair of elongate and upright supports disposed in sidewardly-spaced relation with one another adjacent the respective end portions, each said support including at least one opening disposed in a side wall thereof, each said openings having a deformed area defining a sidewardly projecting rib which is integral therewith and extends on a load-bearing edge of the respective opening and beyond the ends of said edges in a direction transverse to the elongated direction of the respective support; and a furniture component and a pair of sidewardly-spaced hanger elements disposed generally adjacent opposite sides thereof, said hanger elements being respectively engaged within a pair of said openings disposed in the respective supports such that said furniture component extends therebetween.

13. The wall panel assembly of claim 12 wherein said furniture component is a cover pad which defines at least part of one of said side surfaces of said wall panel assembly.

14. The wall panel assembly of claim 12 wherein said furniture component comprises one of a shelf, a storage unit, and a worksurface mounted on and projecting sidewardly from one of said side surfaces of said wall panel assembly.

15. The panel system of claim 12 wherein said supports are of a one-piece, monolithic roll-formed construction having a continuous side wall structure, said side walls being integral with and forming part of said side wall structure.

16. The wall panel assembly of claim 12 wherein said supports are lower supports and each has a tubular configuration defining a hollow interior, each said lower support includes a pair of said side walls disposed in opposed but spaced-apart relation with one another, each said side wall defining therein a plurality of said openings disposed in a vertical row along a substantial portion of the vertical extent thereof and each said opening having a said rib extending along a load-bearing edge thereof, said ribs projecting inwardly into said hollow interior of the respective lower support, said wall panel assembly further including a pair of upper supports each including a bayonet-like connector projecting downwardly from a lower end thereof, each of said connectors being snugly engaged within an open upper end of a said lower support between an opposed pair of said ribs thereof.

17. A support structure comprising:

a vertically elongate first support element oriented in a generally upright manner, said first support element having a tubular side wall which includes therein at least one opening, said side wall being deformed to define a sidewardly projecting reinforcing rib which is integral with said side wall, said rib being positioned immediately adjacent said opening so as to define a load-bearing edge of said opening which projects sidewardly beyond one other edge of said opening; and a second support element mounting a hanger thereon, said hanger being engaged within said opening to mount said second support element on said first support element.

18. The support structure of claim 17 wherein said side wall of said first support element is a continuous, monolithic, one-piece roll-formed component.

19. The support structure of claim 17 wherein said rib extends along said edge of said opening in a direction transverse to an elongated direction of said first support element.

20. The support structure of claim 17 further including a pair of said first support elements disposed in laterally-spaced relation with one another, and said second support element includes a pair of said hangers thereon each engaging within a said opening of one of said support elements such that said second support element extends between and is supported on said first support elements.

21. The support structure of claim 20 wherein said hangers comprise hook-shaped elements.

22. The support structure of claim 17 wherein a plurality of said openings are disposed in said side wall in vertically spaced relation with one another so as to define a vertical row, said openings being vertically elongated in shape and a said rib extends along and defines a load-bearing edge of each said opening to reinforce same.

23. The support structure of claim 22 wherein said ribs are horizontally elongated and extend along both upper and lower edges of each said opening, said ribs of each said opening being parallel with one another.

24. The support structure of claim 23 wherein said ribs have a horizontal dimension which is greater than a horizontal width of the respective openings as defined between a pair of upright edges thereof.

25. The suppport structure of claim 17 wherein said side wall and said rib are of a uniform wall thickness throughout.

26. The wall system of claim 1 wherein said one edge projects laterally beyond at least one other edge of said opening.

27. The wall system of claim 1 wherein said dimple is defined by a linearly extending and raised rib positioned immediately adjacent said opening so as to define said one edge thereof, said one edge projecting inwardly beyond at least one other edge of said opening.

28. The panel system of claim 9 wherein said rib defines said lower edge and is deformed inwardly such that said lower edge is horizontally offset from at least one other edge of said opening.

29. The panel system of claim 28 wherein said rib extends linearly between a pair of upright and parallel edges of said opening, said rib being perpendicular relative to said upright edges and extending sidewardly beyond each said upright edge.

30. The wall panel assembly of claim 12 wherein said rib is disposed immediately adjacent said opening so as to define said load bearing edge thereof, said load-bearing edge being inwardly offset relative to another edge of said opening.

31. The support structure of claim 17 wherein said rib extends linearly along said side wall.

32. The support structure of claim 31 wherein said load-bearing edge is a lower edge, and said opening includes an upper edge which is substantially parallel to said lower edge, and a pair of upright side edges which are substantially perpendicular to said upper and lower edges, and a pair of said ribs are positioned immediately adjacent said opening so as to respectively define said upper and lower edges thereof, each said upper and lower edge projecting inwardly beyond said upright side edges such that said upper and lower edges are horizontally offset from said upright side edges.

* * * * *

UNITED STATES PATENT AND TRADEMARK OFFICE

CERTIFICATE OF CORRECTION

PATENT NO. : 6,748,997 B2
DATED : June 15, 2004
INVENTOR(S) : Nicholas J. Fricano et al.

It is certified that error appears in the above-identified patent and that said Letters Patent is hereby corrected as shown below:

Title page,
Item [75], Inventors, "Nicholas Fricano" to -- Nicholas J. Fricano --

Column 9,
Line 24, should read as follows:
-- 1. A space-dividing wall system comprising:
first and second portable upright panel assemblies each having a vertically elongate upright end edge and a pair of oppositely facing and generally planar vertically oriented side surfaces which transversely relative to the respective said end edges; and a vertically elongate support element interposed between the respective end edges of said first and second panel assemblies and having a pair of vertically elongate and oppositely facing walls, each of said walls defining therein a plurality of openings disposed in vertically spaced relation with one another for respectively receiving load-bearing connectors associated with a furniture component, wherein upper and lower edges of each said opening are deformed to define respective inwardly projecting dimples which are vertically spaced from one another along said support element and which extend transversely along the respective upper and lower edges relative to the elongated direction of said post to reinforce said post adjacent said openings thereof. --

Column 9,
Line 42, Claim 2 was cancelled by amendment.
Line 51, should read as follows:
-- 4. The wall panel system of Claim 3 wherein said dimples are parallel with one another and are horizontally elongated so as to extend beyond the horizontal width of the respective opening as defined between a pair of generally upright edges thereof. --

Column 10,
Line 1, should read as follows:
-- 7. The wall panel system of Claim 1 wherein said openings have a vertically elongate rectangular configuration defined by generally parallel and horizontal said upper and lower edges and a pair of generally parallel and vertical side edges which extend between said upper and lower edges, each said dimple being oriented perpendicularly relative to the respective side edges and extending horizontally beyond same. --

UNITED STATES PATENT AND TRADEMARK OFFICE

CERTIFICATE OF CORRECTION

PATENT NO. : 6,748,997 B2
DATED : June 15, 2004
INVENTOR(S) : Nicholas J. Fricano et al.

It is certified that error appears in the above-identified patent and that said Letters Patent is hereby corrected as shown below:

Column 10,
Line 10, should read as follows:
-- 9. A space-dividing wall panel system comprising:

a pair of upright, vertically elongate and laterally spaced support posts each having a lower end disposed in supportive engagement with a floor, each said support post having a tublar configuration defining a generally hollow interior and an outwardly facing side wall defining therein a plurality of vertically spaced openings, each of said side walls having deformed areas defining respective ribs, each said rib extending generally horizontally on lower edge of each of said openings and sidewardly beyond respective ends of said lower edge;

a panel assembly disposed between and supported on said support posts and defining a generally vertically oriented side surface; and a pair of laterally-spaced and generally hook-shaped elements, one of said elements being engaged within a said opening of one of said support posts and the other said element being engaged within a said opening of the other said support post; and a furniture component positioned adjacent said side surface of said panel assembly and extending between and connected to said elements for support from said posts.

Line 41, should read as follows:

12. An upright space-dividing wall panel assembly comprising:

a pair of generally vertically oriented and generally planar side surfaces and a pair of sidewardly-spaced upright end portions oriented transversely relative to said side surfaces;

a pair of elongate and upright supports disposed in sidewardly-spaced relation with one another adjacent the respective end portions, each said support including at least one opening disposed in a side wall thereof, each said side wall defining a sidewardly projecting rib deformed therefrom and which extends along a load-bearing edge of said opening in a direction transverse to the elongated direction of the respective support, said rib extending sidewardly beyond one other edge of said opening; and a furniture component and a pair of sidewardly-spaced hanger elements disposed generally adjacent opposite sides thereof, said hanger elements being respectively engaged within said opening disposed in the respective supports such that said furniture component extends therebetween.

UNITED STATES PATENT AND TRADEMARK OFFICE

CERTIFICATE OF CORRECTION

PATENT NO. : 6,748,997 B2
DATED : June 15, 2004
INVENTOR(S) : Nicholas J. Fricano et al.

It is certified that error appears in the above-identified patent and that said Letters Patent is hereby corrected as shown below:

Column 11,
Line 22, should read as follows:
-- 17. A support structure comprising:
a vertically elongate first support element oriented in a generally upright manner, said first support element having a tubular side wall which includes therein at least one opening, said side wall being deformed to define an inwardly projecting reinforcing rib which is integral with said side wall, said rib being positioned immediately adjacent said opening so as to define a load-bearing edge of said opening which projects both inwardly beyond one other edge of said opening and sidewardly beyond one other edge of said opening ; and
a second support element mounting a hanger thereon, said hanger being engaged within said opening to mount said second support element on said first support element. --

Column 12,
Line 11, should read as follows:
-- 24. The support structure of Claim 23 wherein said ribs have a horizontal dimension which is greater than a horizontal width of the respective openings as defined between pairs of upright edges thereof. --
Line 14, should read as follows:
-- 25. The support structure of Claim 17 wherein side wall and said rib are of a uniform wall thickness throughout. --
Line 16, should read as follows:
-- 26. The wall system of Claim 1 wherein said upper and lower edges project inwardly beyond at least one other edge of said opening. --
Line 19, should read as follows:
-- 27. The wall system of Claim 1 wherein each said dimple is defined by a linearly extending and raised rib positioned immediately adjacent said opening so as to define the respective said upper to lower edge thereof, said one edge projecting inwardly beyond at least one other edge of said opening. --
Line 24, should read as follows:
-- 28. The panel system of Claim 9 wherein each said rib defines the respective said lower edge and is deformed inwardly such that said lower edge is horizontally inwardly offset from at least one other edge of the respective said opening. --
Line 28, should read as follows:
-- 29. The panel system of Claim 28 wherein each said rib extends linearly between a pair of upright and parallel edges of the respective said opening positioned at the respective ends of said lower edge thereof, said rib being perpendicular relative to said upright edges and extending sidewardly beyond each said upright edge.

UNITED STATES PATENT AND TRADEMARK OFFICE

CERTIFICATE OF CORRECTION

PATENT NO. : 6,748,997 B2 
DATED : June 15, 2004
INVENTOR(S) : Nicholas J. Fricano et al.

It is certified that error appears in the above-identified patent and that said Letters Patent is hereby corrected as shown below:

Column 12, (cont'd),
Line 39, should read as follows:
-- 32. The support structure of Claim 31 wherein said load-bearing edge is a lower edge, and said opening includes an upper edge which is substantially parallel to said lower edge, and a pair of upright side edges which are substantially perpendicular to said upper and lower edges, and a pair of said ribs are positioned immediately adjacent said opening so as to respectively define said upper and lower edges thereof, each said upper and lower edge projecting inwardly beyond said upright side edges such that said upper and lower edges are horizontally inwardly offset from said upright side edges. --

Signed and Sealed this

Tenth Day of May, 2005

JON W. DUDAS
*Director of the United States Patent and Trademark Office*